US006933937B2

(12) United States Patent
Agarwal et al.

(10) Patent No.: US 6,933,937 B2
(45) **Date of Patent: *Aug. 23, 2005**

(54) PIXEL CLOCK PLL FREQUENCY AND PHASE OPTIMIZATION IN SAMPLING OF VIDEO SIGNALS FOR HIGH QUALITY IMAGE DISPLAY

(75) Inventors: Sandeep Agarwal, Fremont, CA (US); Arun Johary, San Jose, CA (US)

(73) Assignee: Genesis Microchip Inc., Alviso, CA (US)

( * ) Notice: Subject to any disclaimer, the term of this patent is extended or adjusted under 35 U.S.C. 154(b) by 107 days.

This patent is subject to a terminal disclaimer.

(21) Appl. No.: 10/640,699

(22) Filed: Aug. 13, 2003

(65) Prior Publication Data

US 2004/0032406 A1 Feb. 19, 2004

Related U.S. Application Data

(63) Continuation of application No. 09/396,016, filed on Sep. 15, 1999, now Pat. No. 6,633,288.

(51) Int. Cl.[7] ..... G09G 5/00

(52) U.S. Cl. ..... 345/213; 345/611; 345/643; 348/536

(58) Field of Search ..... 345/213, 611–617, 345/643; 348/536, 537, 607, 625; 382/284

(56) References Cited

U.S. PATENT DOCUMENTS

| | | | | |
|---|---|---|---|---|
| 4,905,085 A | | 2/1990 | Faulhaber | 348/537 |
| 5,256,875 A | | 10/1993 | Hoekman et al. | 250/282 |
| 5,321,750 A | | 6/1994 | Nadan | 380/20 |
| 5,767,916 A | | 6/1998 | West | 348/537 |
| 5,805,233 A | | 9/1998 | West | 348/537 |
| 5,835,155 A | | 11/1998 | Jennes et al. | 348/536 |
| 5,847,701 A | | 12/1998 | Eglit | 345/204 |
| 6,011,538 A | | 1/2000 | Eglit | 345/127 |
| 6,097,444 A | | 8/2000 | Nakano | 348/607 |
| 6,147,668 A | | 11/2000 | Eglit | 345/99 |
| 6,160,443 A | * | 12/2000 | Maalej et al. | 329/304 |
| 6,166,775 A | * | 12/2000 | Fukuda | 348/537 |
| 6,633,288 B2 | * | 10/2003 | Agarwal et al. | 345/213 |

* cited by examiner

*Primary Examiner*—Ricardo Osorio
(74) *Attorney, Agent, or Firm*—Beyer Weaver & Thomas, LLP

(57) ABSTRACT

Pixel clock frequency and optimum sampling phase adjustment is an important requirement in Flat panel display monitors (FPDM) with an analog video interface. This invention proposes a new and more advanced method for frequency an optimum sampling phase determination. It is based on analyzing the content of the image to arrive at an optimum value of phase and frequency by directly optimizing image quality. The method differs from exsisting methods on two counts. First, no assumptions are needed about the precise value of expected frequency. Second, instead of following a two step approach of first determining frequency and then phase, this invention makes possible a single pass phase-frequency optimization.

18 Claims, 4 Drawing Sheets

PIXEL CLOCK PLL FREQUENCY AND PHASE OPTIMIZATION IN SAMPLING OF VIDEO SIGNALS FOR HIGH QUALITY IMAGE DISPLAY

CROSS REFERENCE TO RELATED APPLICATIONS

This application is a continuation of prior U.S. application Ser. No. 09/396,016, filed on Sep. 15, 1999, now U.S. Pat. No. 6,633,288, from which priority under 35 U.S.C. §120 is claimed, and which is incorporated herein in its entirety by reference.

FIELD OF THE INVENTION

The present invention relates to providing images on a display and more particularly to providing and optimizing an image displayed from video signals.

BACKGROUND OF THE INVENTION

Pixel clock frequency and optimum sampling phase adjustment is an important requirement in flat panel display monitors (FPDM) with an analog video interface. This invention proposes a new and more advanced method for frequency and optimum sampling phase determination. It is based on analyzing the content of the image to arrive at an optimum value of phase and frequency by directly optimizing image quality. The method differs from existing methods on two counts. First, no assumptions are needed about the precise value of expected frequency. Second, instead of following a two step approach of first determining frequency and then phase, this invention makes possible a single pass phase-frequency optimization.

Transfer of pixels, lines and frames from the PC to the monitor follows a predefined and synchronous timing format. Besides the active data transfer period, inactive regions are required on top, bottom, left and right of a frame. In CRT monitors this time is allocated for retrace of the electron beam from end of one line to the beginning of the next line, or from end of a frame to beginning of the next frame. In LCD monitors, various housekeeping functions are performed by the drive electronics during the inactive region. FIG. 1 shows the timing relationships between pixels, lines and frames. The Pixel Clock controls the basic pixel transmission rate. HSYNC is the horizontal synchronization frequency and marks the beginning of each line. Similarly VSYNC is used for vertical synchronization and marks the beginning of each frame. Data Enable (DE) is valid for the active period during which pixel data is transmitted.

Standard analog video interface between the PC and the monitor consists of the three RGB signals as well as horizontal and vertical synchronization signals. In Flat panel displays where the analog RGB video signals have to be converted into a digital format, it is important to sample the incoming signal at the pixel clock rate at an optimum sampling phase.

An example of vertical pin-stripe image highlights the importance of frequency and phase optimization. FIG. 2 shows the relationship between incoming video data and sampling clock phase and frequency. For a vertical pinstripe image, alternating dark and bright pixels constitute the data signals. Due to channel bandwidth limitations, the data signals have a finite risetime. If the frequency of sampling is different from the pixel clock, the sampled data points do not correspond to actual pixel data. Consequently, vertical bands appear on the screen due to aliasing in the frequency domain. In addition, the active width of the image is modified. If the frequency but sampling phase is not optimum, differences in values of two consecutive pixels becomes small leading to poor contrast in the image. Determining the correct pixel clock frequency and finding the optimum sampling phase are crucial to obtain high quality images.

EXISTING METHODS

The first generation flat panel monitors used On-screen display (OSD) based manual control to determine these parameters. Later, multi-synching techniques were developed where pixel clock frequency was deduced from the horizontal (HSYNC) and vertical (VSYNC) synchronization signal timings using table-based comparisons. Current monitors incorporate further refinements in pixel clock frequency determination by taking number of pixels between the borders of the image being displayed into account. Some degree of automation has been achieved in sampling phase adjustment as well based on techniques ranging from "centering" of the sampling frequency to "contrast maximization". Following is a brief description of existing techniques for frequency determination and phase optimization.

Manual Adjustment

In this case the phase and frequency are varied the correct value of phase and frequency which optimize image quality and/or size.

Size Adjustment

In size based adjustment, the horizontal size of the active area of the image (calculated in number of pixels) is deducted. The actual size is measured between the left edge of the active image and right edge of the active image. The frequency is adjusted until the actual size is within one pixel of the expected size. Subsequently phase is adjusted such that the actual and expected sizes are identical.

Table Based Techniques

In this method, the frequency and polarity of HSYNC and VSYNC signals is measured. A table maps these parameters to the pixel clock frequency.

Contrast Maximization

This method is used for sampling phase optimization. In this method, the absolute difference between two neighboring pixels is monitored as a function of sampling phase. The optimum value of phase is the highest value of the difference and corresponds to maximum contrast in the image.

LIMITATIONS OF EXISTING METHODS

Existing methods have several limitations, which have an impact on the quality of adjustment procedure as well as time taken to adjust pixel phase and frequency. Manual Adjustment is reliable and can be used to adjust most images. However, it is extremely cumbersome and tedious and besides taking a long time, it requires the user to be very familiar and skilled with the adjustment procedure. Size Adjustment which is the existing method of automatic adjustment lead to accurate frequency for images which have a standard horizontal size and/or deducing the expected value of horizontal size is simple. Moreover, the method requires the images to have well defined borders at left and right edges. This leads to several situations where size based adjustment procedures fail to yield best results. Table based frequency adjustment works only for know video modes which are included in the table and fail whenever the video timings are non-standard. Contrast optimization works under the assumption that the value of frequency has been determined correctly.

Accordingly, what is needed is a system and method that overcomes the above-identified problems. The present invention addresses such a need.

SUMMARY OF THE INVENTION

Pixel clock frequency and optimum sampling phase adjustment is an important requirement in Flat panel display monitors (FPDM) with an analog video interface. This invention proposes a new and more advanced method for frequency and optimum sampling phase determination. It is based on analyzing the content of the image to arrive at an optimum value of phase and frequency by directly optimizing image quality. The method differs from existing methods on two counts. First, no assumptions are needed about the precise value of expected frequency. Second, instead of following a two step approach of first determining frequency and then phase, this invention makes possible a single pass phase-frequency optimization.

DETAILED DESCRIPTION

The present invention relates to an optimization technique for providing graphic images.

PREFERRED EMBODIMENT OF THE INVENTION

Figure 1:
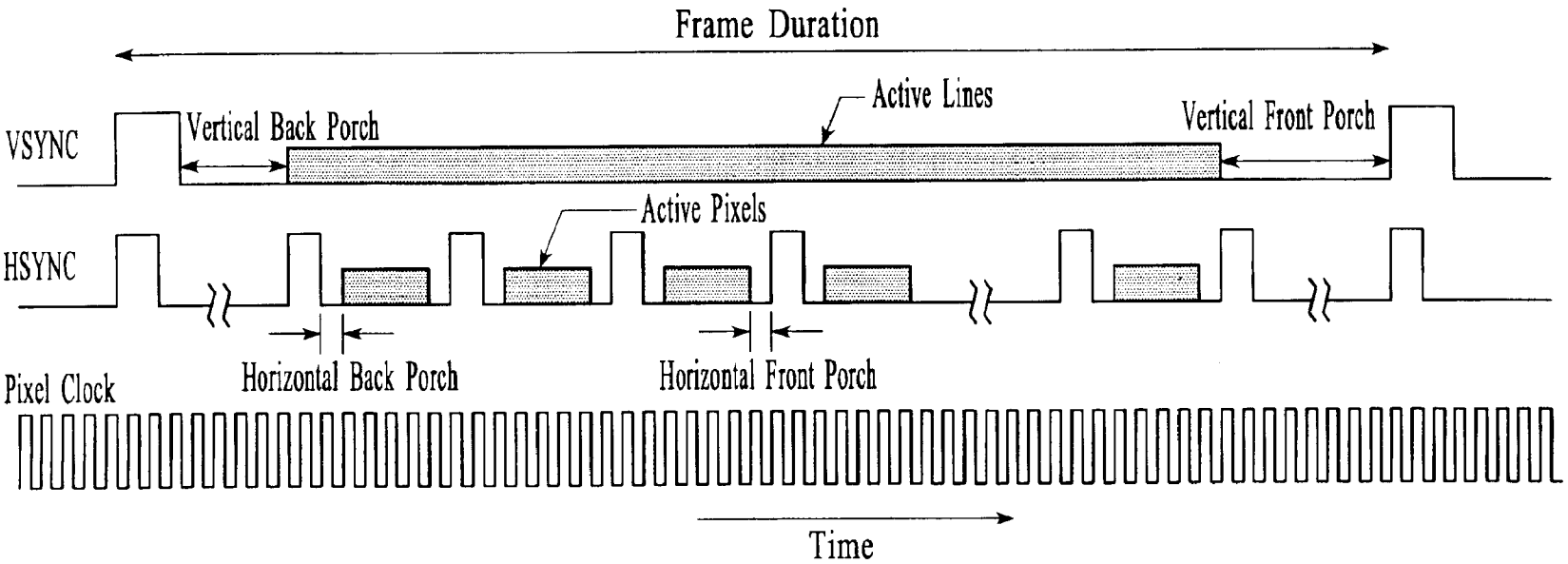
FIG. 1 shows the timing relationships between pixels, lines and frames.
Figure 2:
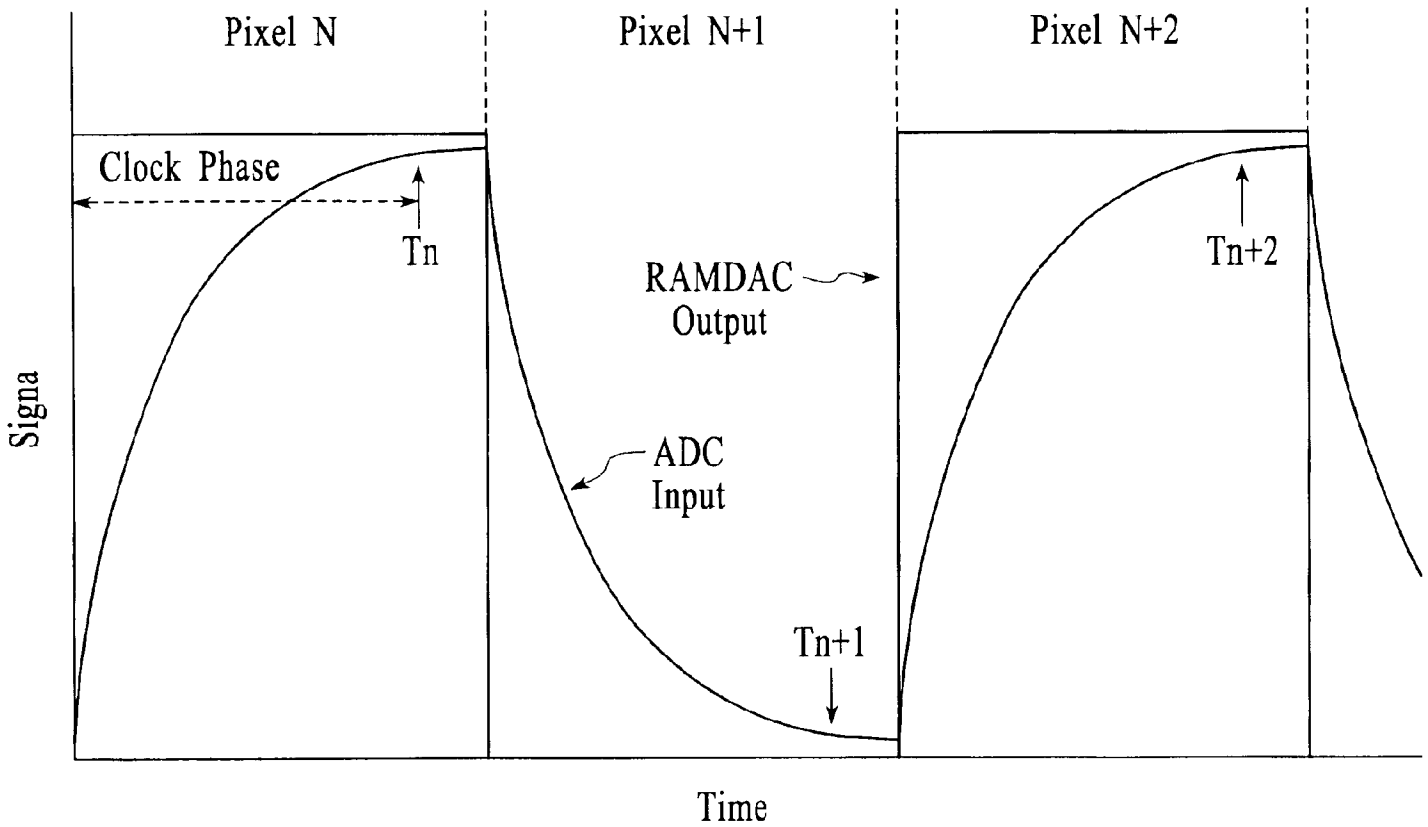
FIG. 2 shows the relationship between incoming video data and sampling clock phase and frequency.
Figure 3:
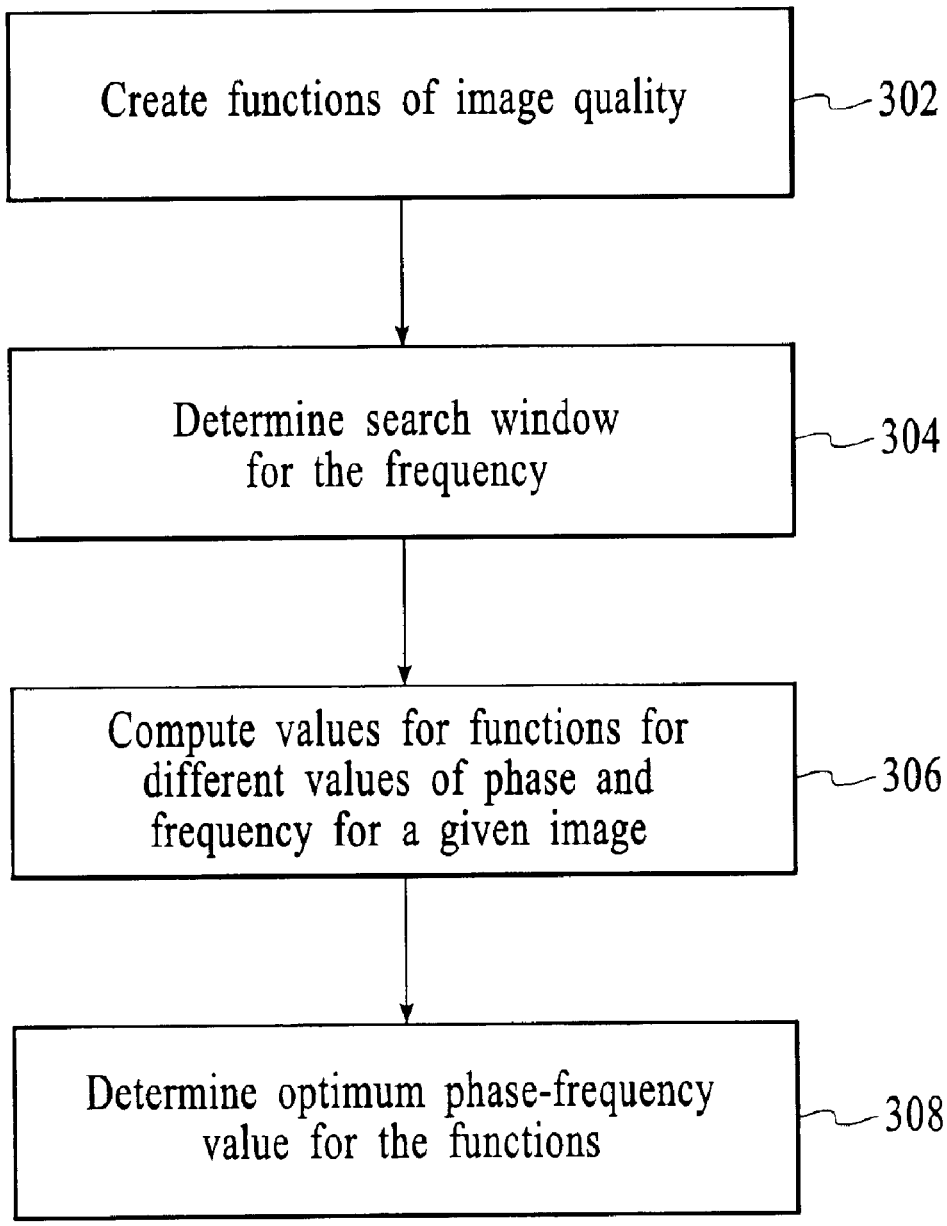
FIG. 3 is a simple flow chart illustrating the optimized technique in accordance with the present invention.
Figure 4:
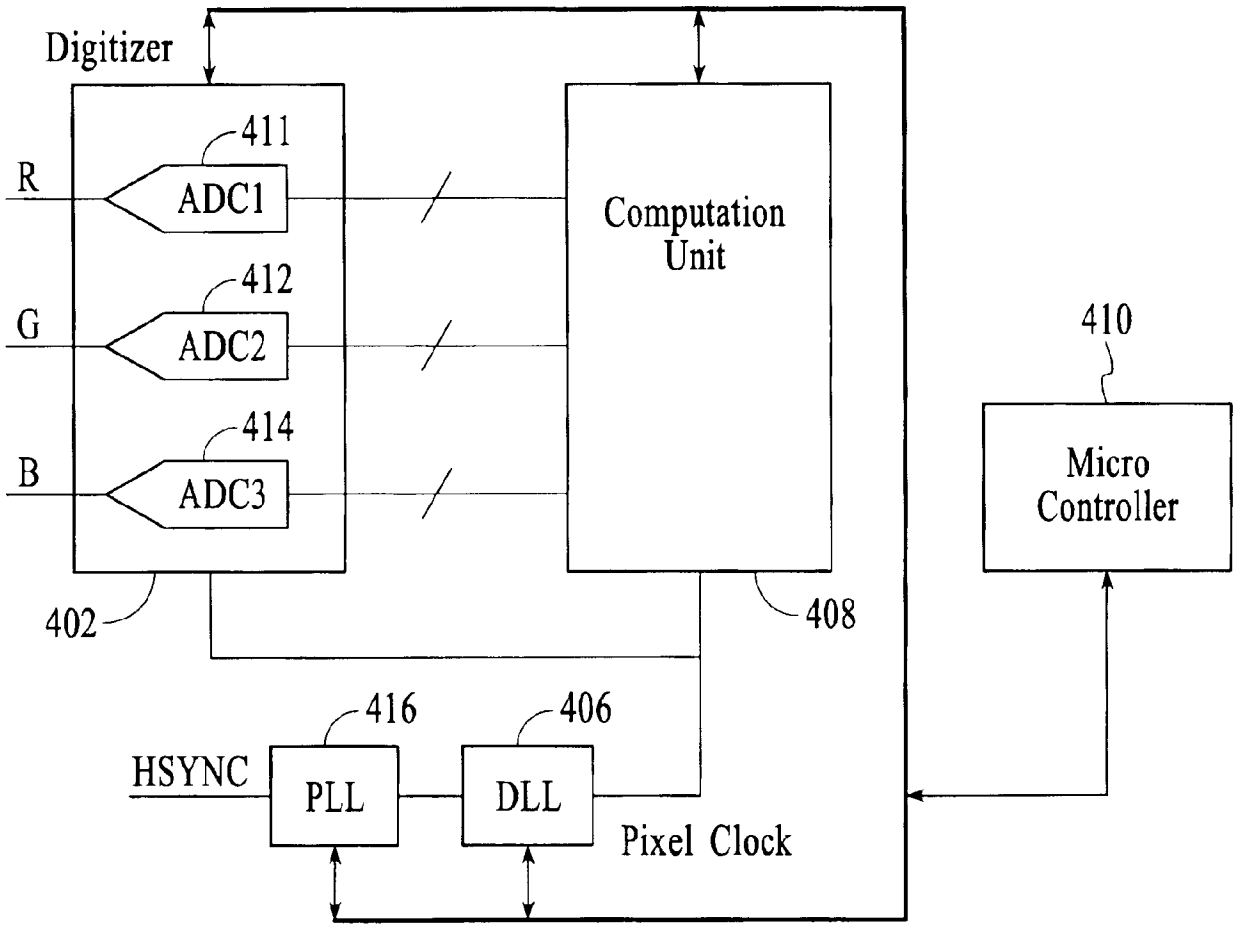
FIG. 4 shows a block diagram of the hardware configuration.

Hardware:

The hardware required for the phase-frequency optimization methods comprises the digitizer 402, the frequency synthesizer 404, and the delay generator (DLL) 406 and computation unit 408. The digitizer 402 comprises three analog to digital converters (ADCs) 411, 412 and 414 in parallel for the Red (R), Green (G), and Blue (B) channels respectively. Frequency synthesis is obtained by a high multiplication ratio phase locked loop (PLL) 416 which multiplies the HSYNC signal by an integral number. The delay generator 406 can introduce inter-pixel phase delays in equal intervals. The digitizer 402 and the frequency synthesizer 404 are a standard part of any analog video interface. The delay generator 406 is generally implemented as a part of the PLL 416 but can be an entirely independent circuit. FIG. 4 shows a block diagram of the hardware configuration. Note that the pixel clock output from the PLL 416 is used as a sampling clock for the three ADCs 411, 412 and 414. The digitized RGB signals along with the synthesized and delayed pixel clock and timing signals are sent to the computation unit 408. The microcontroller 410 can change the PLL 416 multiplication ratio, which sets the pixel clock frequency. It can also control the DLL 406 setting in order to adjust sampling phase.

The principal function of the computation unit 408 is to perform measurements on the incoming RGB pixel data. It does this by a number of microcontroller programmable functions. Each function requires three types of inputs. These are:

The specific computation to be performed.

Coordinates of the image where the pixels need to be computed

The specific color (R, G or B) over which the computation is performed.

The coordinates of an image are specified in terms of X-coordinate and Y-coordinate. The X-coordinate specifies the location of a pixel in a particular horizontal line while the Y coordinate specifies the line number. Each pixel in the frame has a unique X-Y location. An Edge is defined as the absolute difference in values of two neighboring pixels. A Window is a rectangular window of arbitrary size with the frame. It is completely defined by coordinates of diagonally located pixels.

The functions that can be performed by the computation unit 408 are as follows:

1. GetPixel: The value of a pixel at X-Y coordinate for R, G or B.
2. GetEdge: The value of edge at X-Y coordinate for R, G or B.
3. GetEdgeCount: The number of edges having a value above a threshold for R, G or B.
4. GetCumulativeEdge: The sum of all edges inside a window having a value above a threshold for R, G or B.
5. GetCumulativeEdge: The sum of all alternate edges inside a window having a value above a threshold for R, G or B.
6. GetMaxEdgeLline: The line in a frame which as maximum number of edges having a value above a threshold for R, G or B.
7. GetMaxEdge: The location and value of the largest edge inside a window for R, G or B.
8. GetMinMaxPixel: The minimum and maximum value of pixels inside a window for R, G, or B.

Procedure:

The method is based on optimizing the image quality. The computation unit 408 can implement two such functions that provide a measure of image quality directly. These are GetCumulativeEdge and GetCumulativeAltEdge. Both these functions have a maximum at the optimum value of phase and frequency. In order to have a high and reliable optimization, it is important to compute these functions in regions in the image where a large number of edges are present. GetEdgeCount, GetMaxEdgeLine, and GetMaxEdge are used to scan the image and zoom into portions of image which have a significant value of edges. Moreover, by using the GetPixel, GetEdge and GetMinMaxPixel functions one can create any arbitrary image quality function.

The actual operation of the optimization is controlled by the microcontroller 410 using programmable instruction sequences coded in firmware. The firmware first performs a coarse estimate of the PLL multiplication ratio based on the frequency of HSYNC and VSYNC signals. The actual procedure is based on the following steps:

1. Measure HSYNC and VSYNC frequencies to determine coarse PLL multiplication ratio.
2. Set PLL multiplication ratio and phase delay (any arbitrary value).
3. Scan input image and search for line with maximum edges.
4. Compute either GetCumulative Edge or GetCumulativeAltEdge.
5. Store the value of the function and the corresponding value of phase and
6. frequency in current registers.
7. Change PLL multiplication ratio and phase delay.
8. Compute either GetCumulative Edge or GetCumulativeAltEdge.
9. Update the value of current registers if the value of function is higher than the stored value.
10. Exit if the full range of phase and frequencies have been scanned.
11. Go to step six.

The value of phase and I'LL multiplication ratio for which the value of function is maximum is the optimum value.

ADVANTAGES OF THE INVENTION

Some of the advantages of the image quality adjustment optimization method are:

The adjustment does not depend on the deduced value of pixel clock frequency

Both size and frequency are determined in the same iterative loop

There are no restrictions on the nature of borders in the image.

Image quality functions can be adaptively chosen based on the nature of input image The method provides a confidence factor in the computation of optimum value Although the present invention has been described in accordance with the embodiments shown, one of ordinary skill in the art will readily recognize that there could be variations to the embodiments and those variations would be within the spirit and scope of the present invention. Accordingly, many modifications may be made by one or ordinary skill in the art without departing from the spirit and scope of the appended claims.

What is claimed is:

1. Computer program product for providing a high quality image from video signals comprising:

computer code for performing analog to digital conversion of video RGB signals;

computer code for determining pixel phase and frequency in a single pass in a window for optimum image quality by analyzing phase performance for a plurality of pixels for a plurality of phases and frequencies wherein a sum of all edges within the window which have a value above a threshold for the R, G or B signal is computed to provide a first function and a sum of all alternate edges within the window which have a value above the threshold for R, G or B is computed to provide a second function, wherein the first and second functions have a maximum at an optimum value of phase and frequency, and computer readable medium for storing the computer code.

2. The computer program product of claim 1 wherein the optimum pixel phase and frequency is determined in the same iteration loop.

3. Computer program product for providing a high quality image from video signals comprising:

computer code for determining pixel phase and frequency in a single pass in a window for optimum image quality by analyzing phrase performance for a plurality of pixels;

computer code for performing analog to digital conversion of video RGB signals wherein a sum of all edges within the window which have a value above a threshold for the R, G or B signal is computed to provide a first function and a sum of all alternate edges within the window which have a value above the threshold for R, G or B is computed to provide a second function, wherein the first and second functions have a maximum at an optimum value of phase and frequency; and computer readable medium for storing the computer code.

4. The computer program product of claim 3 wherein the optimum pixel phase and frequency is determined in the same iteration loop.

5. Computer program product for providing a high quality image from video signals comprising:

computer code for performing analog to digital conversion of video RGB signals;

computer code for determining optimum pixel phase and frequency in a single pass and in the same iteration loop for optimum image quality by analyzing phase performance for a plurality of pixels for a plurality of phases and frequencies, wherein the pixel phase and frequency are determined in a single pass in a window, and wherein a sum of all edges within the window which have a value above a threshold for the R, G or B signal is computed, or a sum of all alternate edges within the window which have a value above the threshold for R, G or B is computed, to provide a function that has a maximum at an optimum value of phase and frequency; and computer readable medium for storing the computer code.

6. The computer program product of claim 5 further including:

computer code for constructing functions which quantitatively measure image quality.

7. The computer program product of claim 5 in which the computer code for determining comprises:

computer code for searching for the optimum value of pixel frequency and phase.

8. The computer program product of claim 7 in which the computer code for determining further includes:

computer code for iteratively obtaining the value of pixel clock phase and frequency without making assumption, about the expected value of frequency.

9. The computer program product of claim 8 in which the computer code for determining further includes:

computer code for analyzing the content of several pixels in a frame to optimize pixel clock frequency and phase.

10. The computer program product of claim 5 in which the speed of search of optimum value of pixel frequency is dependent on an accuracy of an initial estimate of the frequency value.

11. The computer program product of claim 5 further comprising:

computer code for providing a computation of an optimum value that provides a confidence factor.

12. The computer program product of claim 11 further comprising:

computer code for determining that if the initial estimate corresponds to an acceptable level; and computer code for terminating the iteration loop.

13. Computer program product for providing a high quality image from video signals comprising:

computer code for determining optimum pixel phase and frequency in a single pass and in the same iteration loop for optimum image quality by analyzing phase performance for a plurality of phases and frequencies;

computer code for performing analog to digital conversion of video RGB signals, wherein the computer code for determining optimum pixel phase and frequency determines the pixel phase and frequency in a single pass in a window, and wherein a sum of all edges within the window which have a value above a threshold for the R, G or B signal is computed, or a sum of all alternate edges within the window which have a value above a threshold for the R, G or B signal is computed, to provide a function that has a maximum at an optimum value of phase and frequency; and computer readable medium for storing the computer code.

14. The computer program product of claim 13 further comprising:

computer code for constructing which quantitatively measure image quality.

15. The computer program product of claim 13 wherein the computer code for determining pixel phase and frequency comprises:

computer code for searching for the optimum value of pixel frequency and phase.

16. The computer program product of claim 13 in which the computer code for determining pixel phase and frequency further comprises computer code for iteratively obtaining the value of pixel, clock phase and frequency without making assumptions about the expected value of frequency.

17. The computer program product of claim 13 in which the computer code for determining pixel phase and frequency analyzes the content of several pixels in a frame to optimize pixel clock frequency and phase.

18. The computer program product of claim 13 in which the speed of search of optimum value of pixel frequency is dependent on initial guess of the frequency value.

* * * * *

UNITED STATES PATENT AND TRADEMARK OFFICE

CERTIFICATE OF CORRECTION

PATENT NO. : 6,933,937 B2
DATED : August 23, 2005
INVENTOR(S) : Agarwal et al.

It is certified that error appears in the above-identified patent and that said Letters Patent is hereby corrected as shown below:

Column 4,
Line 13, change "5. GetCumulativeEdge" to -- 5. GetCumulativeAltEdge --.

Column 6,
Line 61, change "constructing which" to -- constructing functions which --.

Signed and Sealed this

Sixth Day of December, 2005

JON W. DUDAS
*Director of the United States Patent and Trademark Office*